US011324996B2

(12) United States Patent
Kikuchi

(10) Patent No.: US 11,324,996 B2
(45) Date of Patent: May 10, 2022

(54) BALANCE TRAINING SYSTEM, CONTROL METHOD AND CONTROL PROGRAM FOR BALANCE TRAINING SYSTEM

(71) Applicant: Toyota Jidosha Kabushiki Kaisha, Toyota (JP)

(72) Inventor: Mitsugu Kikuchi, Miyoshi (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 110 days.

(21) Appl. No.: 16/812,617

(22) Filed: Mar. 9, 2020

(65) Prior Publication Data

US 2020/0289883 A1 Sep. 17, 2020

(30) Foreign Application Priority Data

Mar. 15, 2019 (JP) ..... JP2019-047886

(51) Int. Cl.
*A63B 22/20* (2006.01)
*A63B 24/00* (2006.01)

(52) U.S. Cl.
CPC ..... *A63B 22/20* (2013.01); *A63B 24/0021* (2013.01); *A63B 24/0087* (2013.01); *A63B 2024/0043* (2013.01); *A63B 2024/0093* (2013.01)

(58) Field of Classification Search
CPC . A63B 22/20; A63B 24/0087; A63B 24/0021; A63B 2024/0093; A63B 2024/0043; A63B 69/0057; A63B 2220/52; A63B 21/0058; A63B 26/003; A63B 71/0054; A63B 2071/0072; A63B 2024/0096; A63B 2071/063; A63B 2230/62
See application file for complete search history.

(56) References Cited

U.S. PATENT DOCUMENTS

| | | | | |
|---|---|---|---|---|
| 9,168,420 | B1 * | 10/2015 | Berme | A63B 22/02 |
| 10,159,872 | B2 * | 12/2018 | Sasaki | A63F 13/214 |
| 2014/0015685 | A1 | 1/2014 | Wei et al. | |

FOREIGN PATENT DOCUMENTS

| | | | |
|---|---|---|---|
| CN | 1825084 | A | 8/2006 |
| CN | 101833287 | A | 9/2010 |
| JP | 2015-100477 | A | 6/2015 |
| JP | 2018-121911 | A | 8/2018 |

* cited by examiner

*Primary Examiner* — Andrew S Lo
*Assistant Examiner* — Andrew M Kobylarz
(74) *Attorney, Agent, or Firm* — Dinsmore & Shohl LLP

(57) ABSTRACT

A balance training system includes a moving carriage configured to be able to move on a moving surface by driving a driving unit, a calculation unit calculating a load's center of gravity of the training person's feet on a boarding surface from the detected load, a setting unit configured to set a stable range, the stable range being a range of the load's center of gravity, and the training person is assumed to maintain upright on the boarding surface in the range; and a control unit performing safety control for ensuring safety during a training attempt for driving the driving unit to move the moving carriage when the control unit determines that the load's center of gravity has fallen outside the stable range or when the control unit predicts that the load's center of gravity is going to fall outside the stable range.

14 Claims, 11 Drawing Sheets

BALANCE TRAINING SYSTEM, CONTROL METHOD AND CONTROL PROGRAM FOR BALANCE TRAINING SYSTEM

CROSS REFERENCE TO RELATED APPLICATIONS

This application is based upon and claims the benefit of priority from Japanese patent application No. 2019-047886, filed on Mar. 15, 2019, the disclosure of which is incorporated herein in its entirety by reference.

BACKGROUND

The present disclosure relates to a balance training system, a control method for the balance training system, and a control program for the balance training system.

A training apparatus for a patient with a disability in his/her leg to perform rehabilitation training is becoming widespread. For example, a training apparatus that moves a footboard with driving means in order to make a training person who performs training stand on the footboard and observe a center of gravity position, and to encourage the naming person to take a step or prevent the training person from falling is known (for example, see Japanese Unexamined Patent Application Publication No. 2015-100477).

SUMMARY

In a configuration in which a footboard moves by a small amount relative to the training apparatus, the training person basically maintains a state in which he/she stands upright with respect to a floor surface, which makes it difficult to maintain the training person's motivation due to poor changes in environment during training. When game characteristics are given to a training attempt, the greater the bodily sensation achieved in association with a game, the greater the training person is motivated to take part in the training attempt. It has been found that a configuration in which a moving carriage is provided in a balance training apparatus and the entire balance training apparatus moves while a training person is on board is effective for rehabilitation training.

However, it may sometimes be difficult for the training person to maintain a state in which the training person is standing on a boarding surface, because a movement amount of the moving carriage in such a balance training apparatus can be set as appropriate, for example, in association with the game. In particular, when the moving carriage is controlled according to how much the load's center of gravity of the training person's feet is displaced from a reference position, for example, if one foot is lifted from the boarding surface, there may be a sudden variation in the movement of the moving carriage that the training person does not expect.

The present disclosure has been made to solve such a problem. An object of the present disclosure is to provide a balance training system and the like that allow a training person having a disease in his/her balance function to perform rehabilitation training safely and effectively.

A first example aspect is a balance training system including: a moving carriage configured to be able to move on a moving surface by driving a driving unit; a detection unit configured to detect a load received from training person's feet standing on the moving carriage; a calculation unit configured to calculate a load's center of gravity of the training person's feet on a boarding surface from the load detected by the detection unit; a setting unit configured to set a stable range, the stable range being a range of the load's center of gravity, and the training person is assumed to maintain upright on the boarding surface in the range; and a control unit configured to perform safety control for ensuring safety during a training attempt for driving the driving unit to move the moving carriage when the control unit determines that the load's center of gravity has fallen outside the stable range based on a result of the calculation by the calculation unit or when the control unit predicts that the load's center of gravity is going to fall outside the stable range based on the result of the calculation by the calculation unit.

When the load's center of gravity of the training person is monitored during the training attempt to perform safety control, it is possible to effectively prevent a sudden movement variation of the moving carriage and make the training person recognize the possibility of a sudden movement variation. That is, rehabilitation training can be performed safely. Further, assuming that such safety control is performed, it is possible to make the training person move the moving carriage actively, and thus the training person can perform rehabilitation training effectively.

In the above balance training system, the setting unit may be configured to set the stable range based on the load's center of gravity calculated by the calculation unit in a calibration work performed by the training person prior to the training attempt. Since the stable range can change depending on the progress of the rehabilitation training of the training person and the training person's condition at that time, calibration may be performed prior to the training attempt.

Further, the control unit may be configured to perform deceleration control for gradually decreasing a moving speed of the moving carriage as the safety control and to perform limit speed control for limiting the moving speed of the moving carriage to less than or equal to a preset limit speed as the safety control. By incorporating such safety control as exception processing, it is possible to effectively prevent a sudden movement variation even in a case where movement control for moving the moving carriage according to the displacement amount of the load's center of gravity is usually performed. Furthermore, the control unit may be configured to perform notification control for getting attention as the safety control. When such notification is performed, the training person can recognize the possibility of a sudden movement variation and take preventive measures such as grasping the handrail.

A second example aspect is a control method for a balance training system for enabling a training person to perform balance training while standing on a moving carriage moving on a moving surface, the control method including: setting a stable range, the stable range being a range of a load's center of gravity, and the training person is assumed to maintain upright on a boarding surface of the moving carriage in the range; detecting a load received from training person's feet standing on the moving carriage; calculating the load's center of gravity of the training person's feet on the boarding surface from the load detected in the detecting; and performing safety control for ensuring safety when it is determined that the load's center of gravity has fallen outside the stable range based on a result of the calculation in the calculating or when it is predicted that the load's center of gravity is going to fall outside the stable range based on the result of the calculation in the calculating. With the balance training system controlled by such a control method, the training person can perform rehabilitation training safely, as discussed above. Further, assuming that such safety control is performed, it is possible to make the training person move the moving carriage actively, and thus the training person can perform rehabilitation training effectively.

A third example aspect is a control program for a balance training system for enabling a training person to perform balance training while standing on a moving carriage moving on a moving surface. The control program causes a computer to execute: setting a stable range, the stable range being a range of a load's center of gravity, and the training person is assumed to maintain upright on a boarding surface of the moving carriage in the range; detecting a load received from training person's feet standing on the moving carriage; calculating the load's center of gravity of the training person's feet on the boarding surface from the load detected in the detecting; and performing safety control for ensuring safety when it is determined that the load's center of gravity has fallen outside the stable range based on a result of the calculation in the calculating or when it is predicted that the load's center of gravity is going to fall outside the stable range based on the result of the calculation in the calculating. With the balance training system controlled by such a control program, the training person can perform rehabilitation training safely, as discussed above. Further, assuming that such safety control is performed, it is possible to make the training person move the moving carriage actively, and thus the training person cam perform rehabilitation training effectively.

According to the present disclosure, it is possible to provide a balance training system and the like that allow a training person having a disease in his/her balance function to perform rehabilitation training safely and effectively.

The above and other objects, features and advantages of the present disclosure will become more fully understood from the detailed description given hereinbelow and the accompanying drawings which are given by way of illustration only, and thus are not to be considered as limiting the present disclosure.

DETAILED DESCRIPTION

Hereinafter, the present disclosure will be described through embodiments of the disclosure, but the disclosure according to the claims is not limited to the following embodiments. Further, all of the configurations described in the embodiments are not necessarily essential as means for solving the problem.

Figure 1:
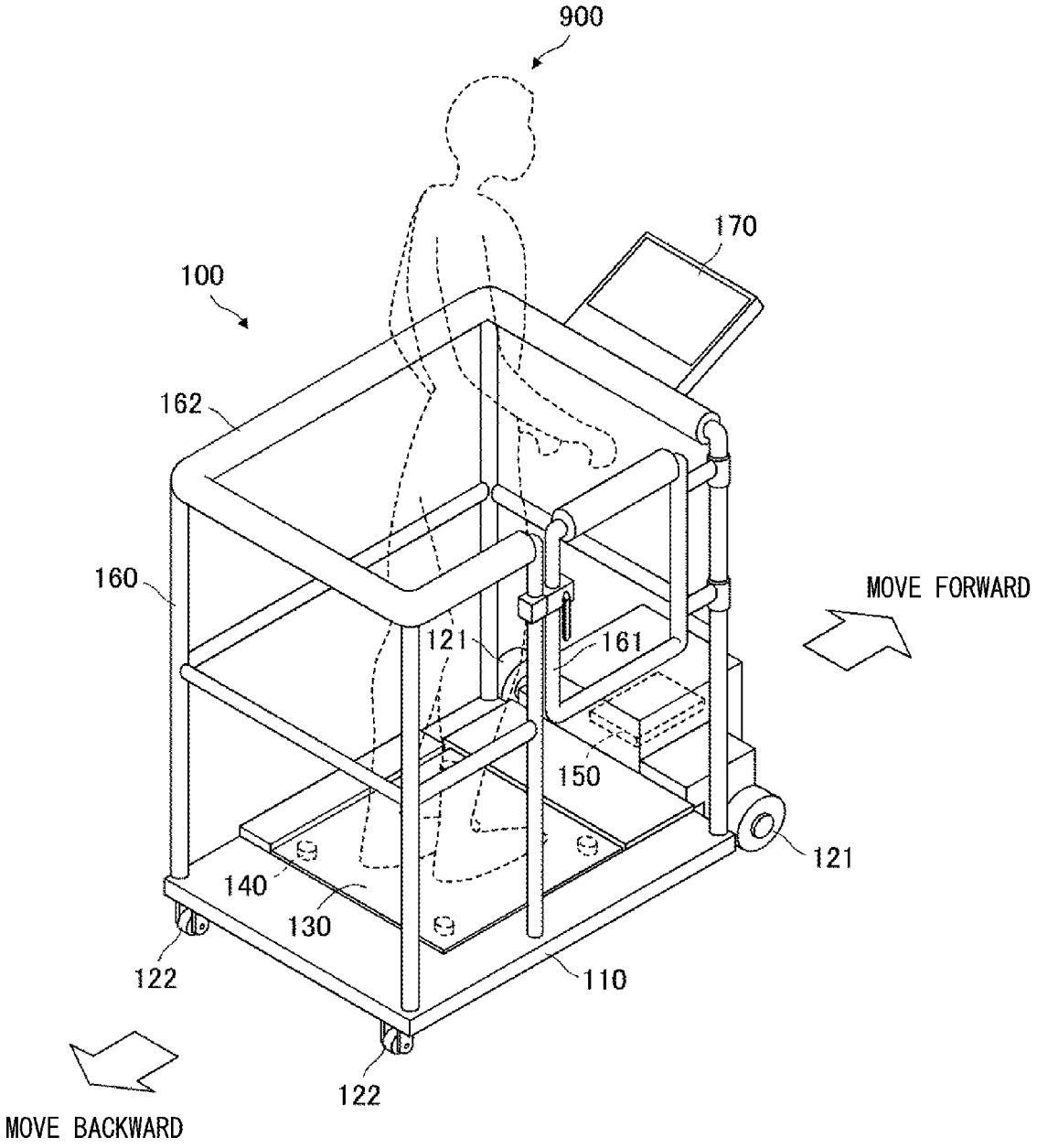
FIG. 1 is a schematic perspective view of a balance training apparatus according to an embodiment.

FIG. 1 is a schematic perspective view of a training apparatus 100 as an example of a balance training apparatus according to this embodiment. The training apparatus 100 is an apparatus for a disabled person with a disability such as hemiplegia to learn to shift his/her center of gravity which is necessary for walking, or for a patient with a disability in his/her ankle joint to recover the ankle joint function. For example, when a training person 900 who wants to recover the ankle joint function tries to continue boarding the training apparatus 100 while maintaining his/her balance, the training apparatus 100 can apply a load that can expect a rehabilitation effect to the training person 900's ankle joint.

The training apparatus 100 includes a moving carriage 110 and a frame 160. The moving carriage 110 is able to move in a front-rear direction on a moving surface that is a floor surface or the like of a rehabilitation facility. The frame 160 is provided to stand on the moving carriage 110 and prevents the training person 900 boarding the moving carriage 110 from falling. The moving carriage 110 mainly includes driving wheels 121, casters 122, a boarding plate 130, load sensors 140, and a control box 150.

The driving wheels 121 are arranged as two front wheels with respect to a traveling direction. Each driving wheel 121 is rotationally driven by a motor (not shown) as a driving unit, and moves the moving carriage 110 forward or backward. The casters 122 are driven wheels and are arranged as two rear wheels with respect to the traveling direction. The boarding plate 130 is a boarding unit on which the training person 900 boards and places his/her feet. A flat plate made of, for example, a polycarbonate resin with a relatively high rigidity that can withstand the boarding of the training person 900 is used as the boarding plate 130. The boarding plate 130 is supported on an upper surface of the moving carriage 110 with the load sensors 140 disposed at four corners interposed therebetween.

Each of the load sensors 140 is, for example, a load cell, and functions as a detection unit that detects a load received from the training person 900's feet standing on the moving carriage 110. The control box 150 accommodates an arithmetic processing unit and a memory, which will be described later.

The frame 160 includes an opening and closing door 161 and a handrail 162. The opening and closing door 161 is opened when the training person 900 boards the boarding plate 130 to form a passage for the training person 900. The opening and closing door 161 is closed and locked when the training person 900 performs a training attempt. The handrail 162 is provided to surround the training person 900 so that it can be grasped when the training person 900 is about to lose his/her balance or feels uneasy. Note that when the training person 900 performs a training attempt, he/she tries to maintain an upright posture by maintaining his/her balance by himself/herself without grasping the handrail 162. The frame 160 supports a display panel 170. The display panel 170 is a display unit that is, for example, a liquid crystal panel. The display panel 170 is disposed at a position where the training person 900 can easily sec during the training attempt.

Figure 2:
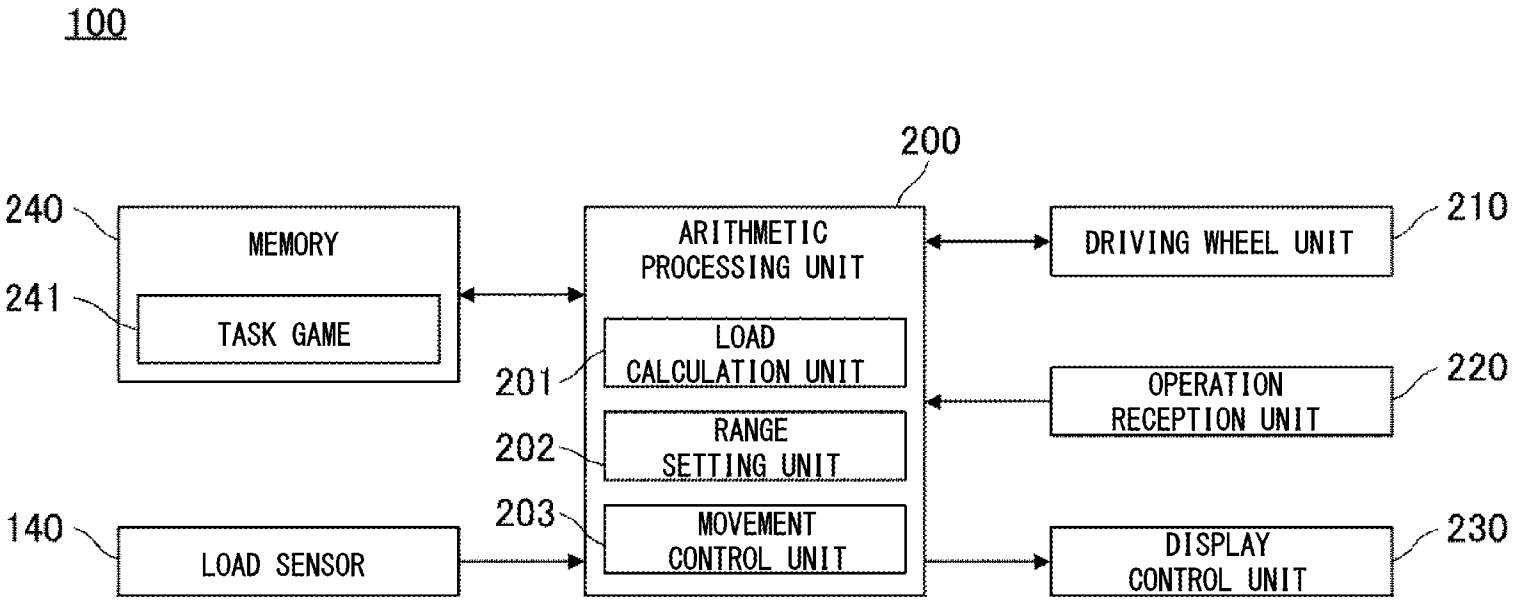
FIG. 2 shows a system configuration of the balance training apparatus.

FIG. 2 shows a system configuration of the training apparatus 100. An arithmetic processing unit 200 is, for example, an MPU and performs control of the entire apparatus by executing a control program read from a memory 240. A driving wheel unit 210 includes a driving circuit and a motor for driving the driving wheels 121. The driving wheel unit 210 includes a rotary encoder that detects an amount of rotation of the driving wheels 121.

An operation reception unit 220 receives input operations from the training person 900 and an operator, and transmits an operation signal to the arithmetic processing unit 200. The training person 900 or the operator operates an operation button provided on the apparatus, a touch panel superimposed on the display panel 170, an attached remote controller, or the like, which constitute the operation reception unit 220, in order to give an instruction for turning on and off the power and for starting a training attempt, to enter numerical values for setting, and to select menu items.

A display control unit 230 generates a graphic video image and the like of a task game, which will be described later, in accordance with a display signal from the arithmetic processing unit 200, and displays the graphic video image and the like on the display panel 170. The memory 240 is a non-volatile storage medium. For example, a solid state drive is used as the memory 240. The memory 240 stores a control program and so on for controlling the training apparatus 100. The memory 240 further stores various parameter values, functions, lookup tables and so on used for control. In particular, the memory 240 stores a task game 241 that is a program for giving a task in a game format so that the training person 900 can enjoy a training attempt. The load sensors 140 detect loads applied from the training person 900's feet via the boarding plate 130, and transmit detection signals to the arithmetic processing unit 200.

The arithmetic processing unit 200 also serves as a function execution unit that performs various calculations and control of individual elements in accordance with a request of the control program. A load calculation unit 201 acquires the detection signals of the four load sensors 140 and calculates a load's center of gravity of the training person 900's feet on the boarding surface. Specifically, since the respective positions of the four load sensors 140 are known, the center of gravity position is calculated from the distribution of the loads in the vertical direction detected by the respective load sensors 140, and the center of gravity position is used as the load's center of gravity. The load's center of gravity is calculated as the center of gravity position of a load distribution in this way, and thus the load's center of gravity can also be regarded as a center of foot pressure applied to the boarding surface by the training person 900's feet.

A range setting unit 202 sets a stable range that is a range of the load's center of gravity estimated that the training person 900 can maintain upright on the boarding surface. A specific setting method will be described later. A movement control unit 203 generates a driving signal to be transmitted to the driving wheel unit 210, and controls the movement of the moving carriage 110 via the driving wheel unit 210. In this embodiment, safety control for ensuring safety is performed during a training attempt in which the motor is driver, and the moving carriage 110 is moved. In this embodiment, in particular, the safety control is performed when it is determined that the load's center of gravity has fallen out of the stable range or when it is predicted that the load's center of gravity may fall out of the stable range. Details of the safety control will be described later.

The arithmetic processing unit 200 may be composed of one or more processors. The load calculation unit 201, the range setting unit 202, and the movement control unit 203 may be composed of one or more processors. Alternatively, the load calculation unit 201, the range setting unit 202, the movement control unit 203, and the display control unit 230 may be composed of one or more processors.

Figure 3:
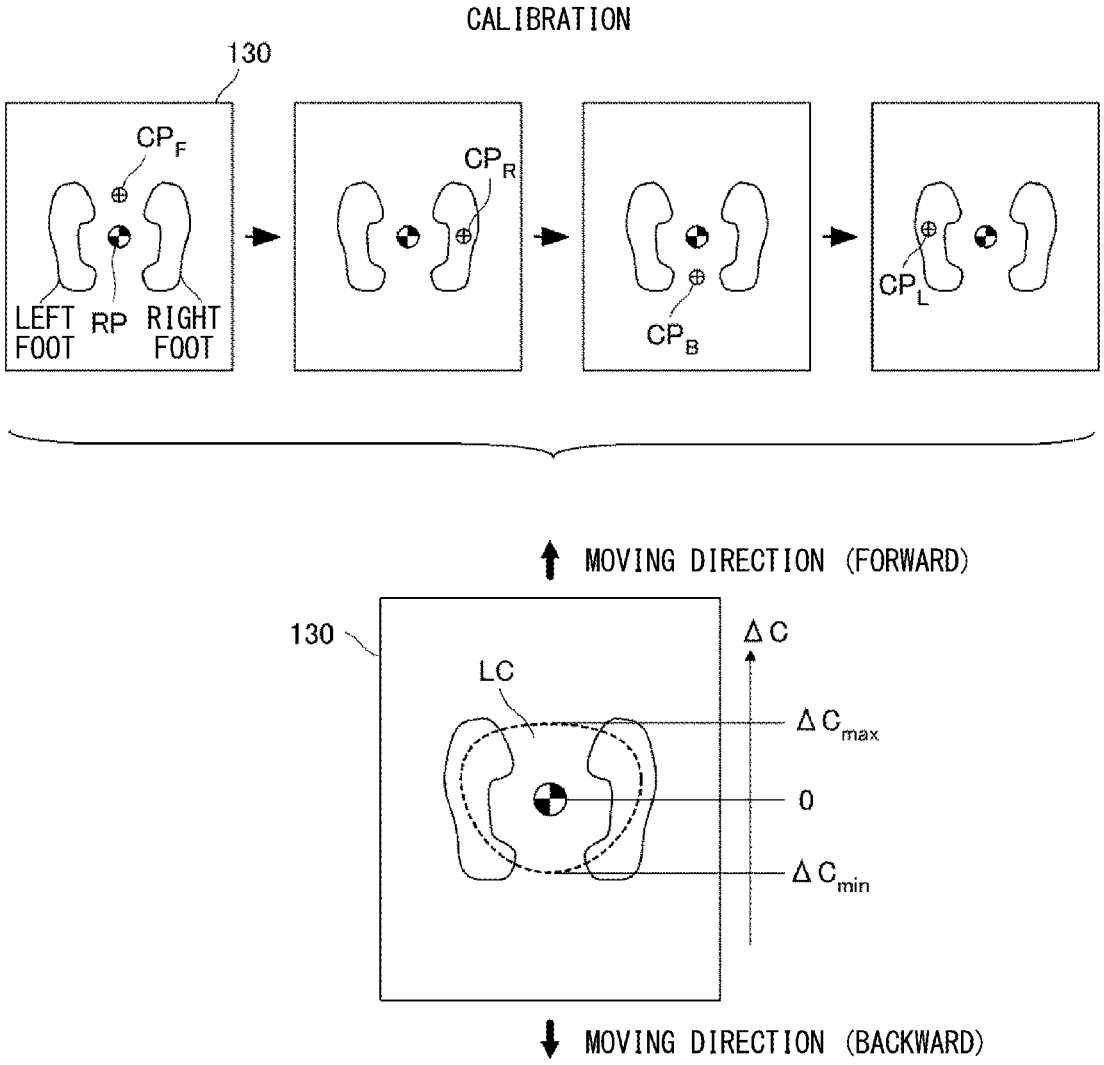
FIG. 3 is a diagram for explaining a setting of a stable range.

FIG. 3 is a diagram for explaining the setting of the stable range. The range setting unit 202 sets a stable range through a calibration work performed by the training person 900 prior to a training attempt. In the calibration work, the training person 900 stands on the boarding surface of the boarding plate 130 with a natural as possible standing posture so that the reference position RP determined with respect to the boarding surface is positioned at a midpoint between the feet. Then, in the order shown in the upper diagram of FIG. 3, while the training person 900 maintains the standing posture, the training person 900 shifts his/her center of gravity forward until right before the heels of the feet are lifted in the air, and then shifts his/her center of gravity on the right foot until right before the left foot is lifted in the air, and then shifts his/her center of gravity backward until right before the toes of the feet are lifted in the air, and lastly shifts his/her center of gravity on the left foot until right before the right foot is lifted in the air. As shown in the drawing, the load calculation unit 201 calculates each load's center of gravity $CP_F$, $CP_R$, $CP_B$, and $CP_L$ for each shift in the center of gravity.

The range setting unit 202 fits a smooth closed curve so as to pass through each load's center of gravity $CP_F$, $CP_R$, $CP_B$, and $CP_L$ calculated in this manner, and sets a range surrounded by the closed curve as a stable range LC. The stable range LC set in this way is a range in which the training person 900 is expected to be able to maintain a standing state by adjusting his/her balance while the load's center of gravity of the training person 900 is included in this range. In this embodiment, since the moving direction of the moving carriage 110 is the front-rear direction, a $\Delta C$ axis is defined along the moving direction within the two-dimensionally defined stable range LC. Along the $\Delta C$ axis, the reference position RP is defined as 0, a maximum value of the stable range LC is defined as $\Delta C_{max}$, and a minimum value of the stable range LC is defined as $\Delta C_{min}$. The stable range LC may be set by selecting, from a preset lookup table, a stable range corresponding to the training person 900's height, weight, foot size, a progress of rehabilitation training, etc., in addition to the stable range LC being set through a calibration work.

In this embodiment, the training person 900 is encouraged to perform training by carrying out the task game 241. The task game 241 processed by the arithmetic processing unit 200 generates a graphic video image that changes every moment and displays the graphic video image on the display panel 170, and the training person 900 is encouraged to perform a moving operation of the training apparatus 100.

Figure 4A:
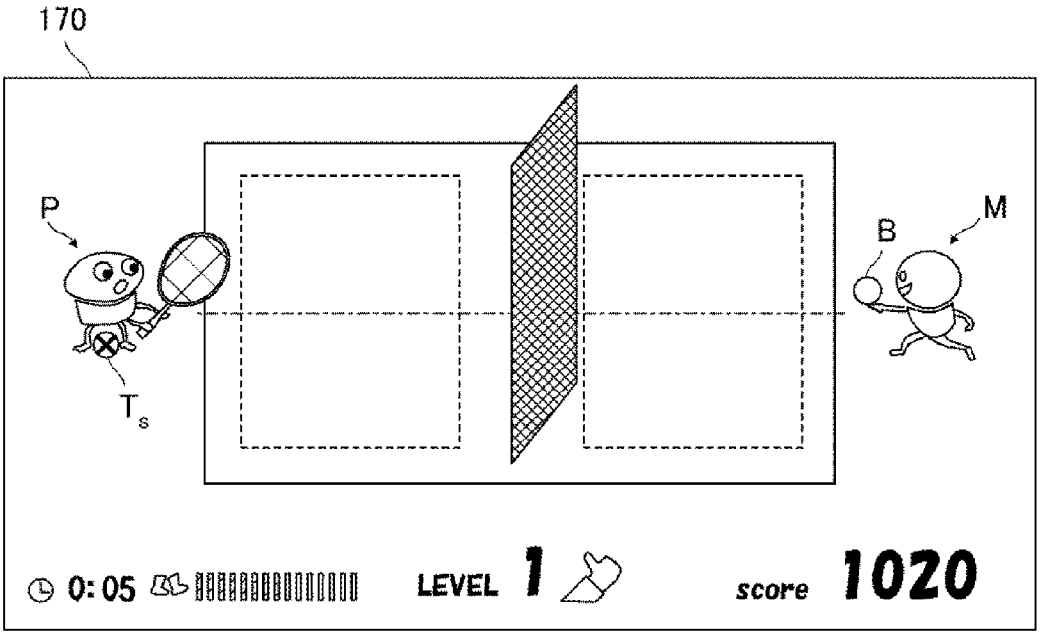
FIG. 4A shows a game screen at the time of starting a training attempt.
Figure 4B:
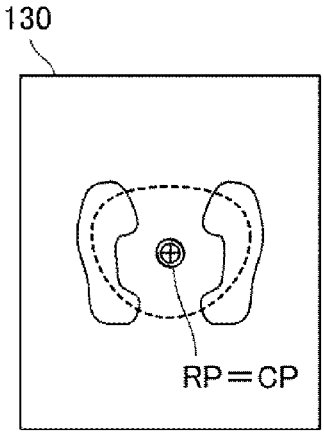
FIG. 4B shows a load's center of gravity of a training person.

FIG. 4A shows a game screen at the time of starting a training attempt, and FIG. 4B shows a load's center of gravity of the training person 900 at that time. The game screen is a video image displayed on the display panel 170, and shows that a game with a tennis concept is selected from among a plurality of task games 241 and then carried out.

On the right side of the tennis court displayed at the center of the screen, a character M throwing a tennis ball B is superimposed on a background image, and on the left side of the tennis court, a character P hitting the thrown tennis ball B back is superimposed on the background image. The character M expresses an action of moving up and down or throwing according to the task given by the task game 241. The character P is a character representing the training person 900 and expresses an action of moving up and down in accordance with the movement of the training apparatus 100 or swinging a racket in accordance with an arrival of the tennis ball B. The tennis ball B reciprocates in the left and right direction on the tennis court in accordance with the actions of the characters M and P. The game screen also includes information such as a score and elapsed time, etc. that change according to a status of the game.

As shown in FIG. 4A, at the time of starting the training attempt, the character P is positioned at an initial position $T_s$ that is the middle in the up and down direction. The character M is also positioned on the opposite side of the initial position $T_s$ with the tennis court interposed therebetween. At this time, it is desirable that the load's center of gravity CP of the training person 900 overlaps with the reference position RP as shown in FIG. 4B. That is, as a preparation for starting a training attempt, the training person 900 stands with a natural as possible standing posture in such a way that the midpoint between the training person 900's feet is positioned at the reference position RP defined for the boarding surface of the boarding plate 130.

Figure 5A:
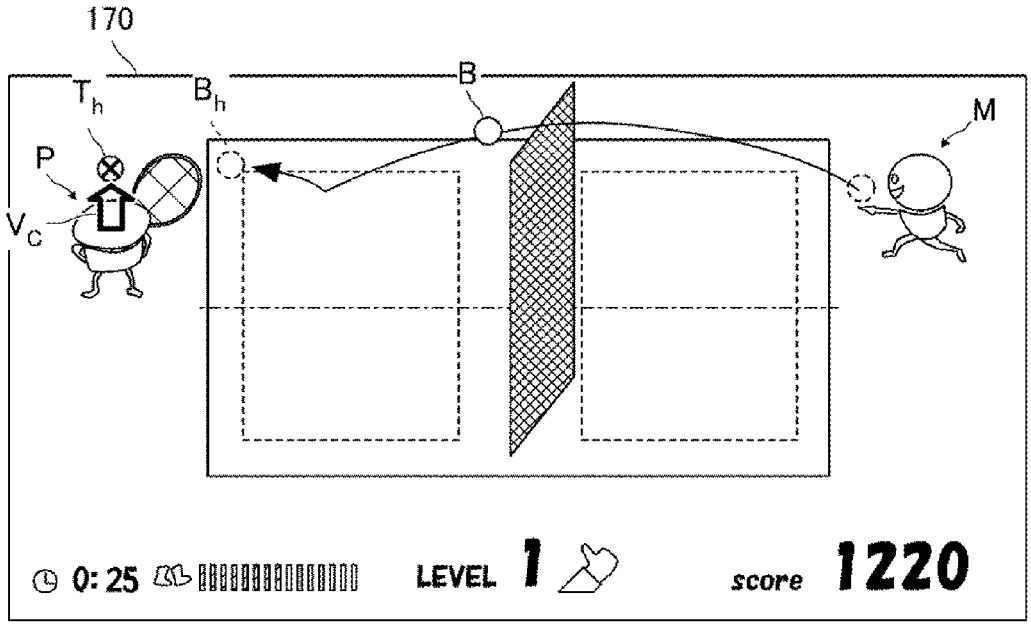
FIG. 5A shows a game screen during a training attempt.
Figure 5B:
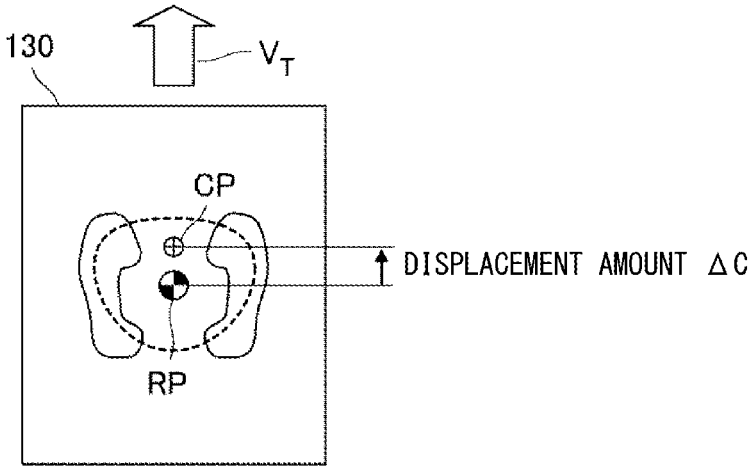
FIG. 5B shows a load's center of gravity of a training person.

FIG. 5A shows a game screen during the training attempt, and FIG. 5B shows the load's center of gravity of the training person 900 at that time. The character M moves to the upper part of the court and throws the tennis ball B so that the tennis ball B can reach a target position $B_h$ set for this task. Then, the tennis ball B moves along the locus shown in the drawing. The speed at which the tennis ball B moves is predetermined according to the level, and is faster as the level becomes higher.

The training person 900 moves the character P to a hitting position $T_h$ where he/she can hit the tennis ball B back at $B_h$ before the tennis ball B reaches $B_h$. That is, as shown in FIG. 5B, the training person 900 moves the load's center of gravity CP forward from the reference position RP by bringing the training person 900's center of gravity forward to adjust his/her balance. The movement control unit 203 moves the moving carriage 110 forward at a target speed $V_T$ set according to a displacement amount ΔC of the load's center of gravity at this time. The character P on the game screen moves to the upper part of the screen at a speed $V_c$ linked with the target speed $V_T$ of the moving carriage 110. When the character P can be moved to $T_h$ before the tennis ball B reaches $B_h$, the racket is shaken when the tennis ball B reaches $B_h$ and the tennis ball B is hit back. When the tennis ball B can be hit back, the score is incremented.

Figure 6A:
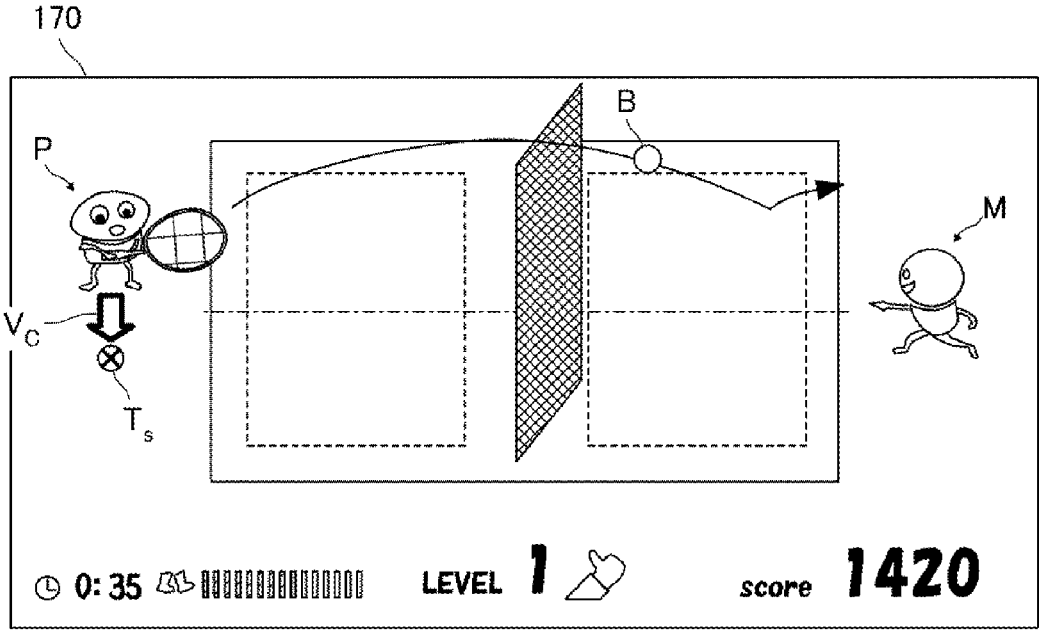
FIG. 6A shows a game screen during a training attempt.
Figure 6B:
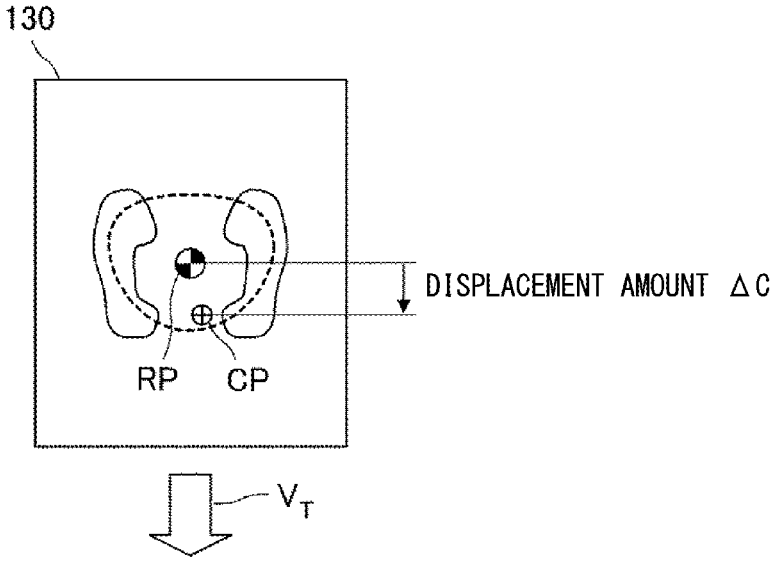
FIG. 6B shows a load's center of gravity of a training person.

FIG. 6A shows a game screen after the training attempt, and FIG. 6B shows the load's center of gravity of the training person 900 at that time. When the character P hits the tennis ball B back, the training person 900 shifts the load's center of gravity CP to behind the reference position RP by shifting the training person's center of gravity backward to adjust his/her balance. The movement control unit 203 moves the moving carriage 110 backward at the target speed $V_T$ set according to the displacement amount ΔC of the load's center of gravity at this time. The character P on the game screen moves to the lower part of the screen at the speed $V_c$ linked with the target speed $V_T$ of the moving carriage 110. When the character P can be returned to the initial position $T_s$ within a predetermined time, the score is incremented.

A certain amount of time is required until the character P reaches the hitting position $T_h$ or returns to the initial position $T_s$, although it depends on the speed $V_c$ of the character P. During this time, the training person 900 continues to adjust his/her balance by tilting his/her center of gravity. This balance adjustment is effective rehabilitation training for the training person 900 with a disease in the balance function. Further, since the load's center of gravity CP can be changed every moment according to the balance adjustment of the training person 900, the target speed $V_T$ of the moving carriage 110 and the speed $V_c$ of the character P can also change. The training person 900 not only moves the character P according to his/her balance adjustment but also moves the training apparatus 109 itself, so that the training person 900 can obtain sensations that act on his/her sense of balance and sense of posture in addition to visual information, and thus the training person 900 can enjoy the training attempt. When the training person 900 can enjoy the training attempt, it can be expected that the training person 900 can actively and continuously perform training. That is, the balance function can be recovered in a shorter period.

Figure 7:
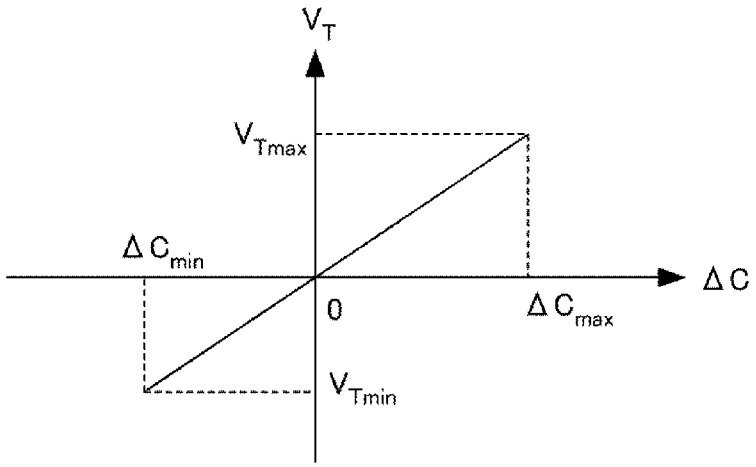
FIG. 7 shows a relationship between a displacement amount of a load's center of gravity and a target speed of a moving carriage.

FIG. 7 is a diagram showing a relationship between the displacement amount ΔC of the load's center of gravity CP and the target speed $V_T$ of the moving carriage 110. The horizontal axis represents the displacement amount ΔC, and the vertical axis represents the target speed $V_T$. When the load's center of gravity CP is within the stable range LC, the movement control unit 203 determines the target speed $V_T$ in proportion to the displacement amount ΔC as shown in the drawing. As shown in FIG. 3, the maximum value that ΔC can take when the load's center of gravity CP is within the stable range LC is $\Delta C_{max}$, and the target speed $V_T$ at that time is $V_{Tmax}$. Likewise, the minimum value that the displacement amount ΔC can take is $\Delta C_{min}$, and the target speed $V_T$ at that time is $V_{Tmin}$. When ΔC is a positive value, the moving carriage 110 moves forward, while when ΔC is a negative value, the moving carriage 110 moves backward. The proportionality coefficient may be determined in accordance with the training level. In this case, the proportionality coefficient may be increased as the training level increases.

The training person 900 who is undergoing rehabilitation training cannot necessarily adjust his/her balance during the training attempt continuously and successfully. The training person 900 may sometimes grasp the handrail 162, or changes his/her step on the boarding plate 130. In particular, since the target speed $V_T$ of the moving carriage 110 with respect to the displacement amount ΔC of the load's center of gravity CP can be appropriately set, the setting may not be appropriate for the training person 900. When the moving carriage 110 is controlled at the target speed $V_T$ that is proportional to the displacement amount ΔC without any restriction measures, when, for example, one foot is lifted from the boarding surface, there may be a sudden movement variation in the moving carriage 110 that the training person 900 does not expect. Therefore, the movement control unit 203 according to this embodiment performs safety control when the load's center of gravity CP calculated by the load calculation unit 201 falls out of the stable range LC.

Figure 8:
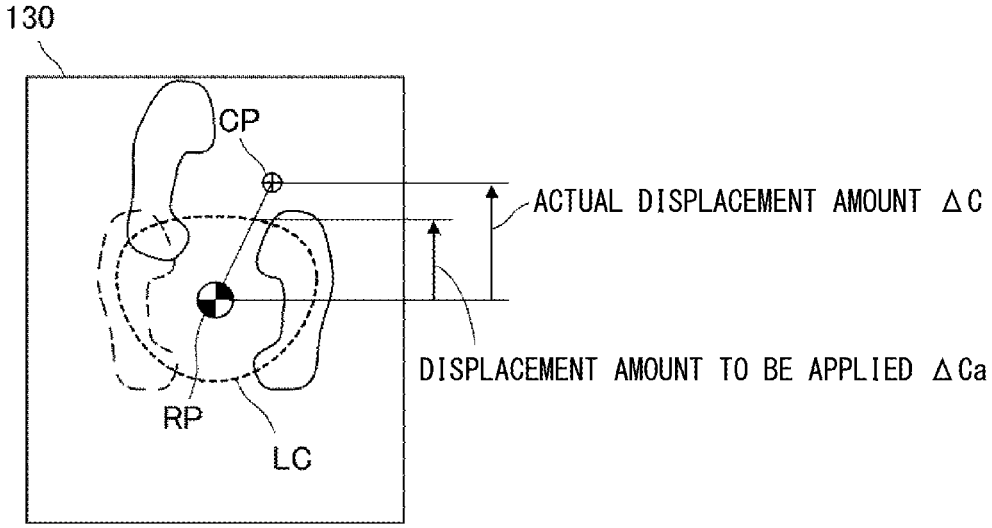
FIG. 8 shows a state in which 3 load's center of gravity is outside a stable range.

FIG. 8 shows a state in which the load's center of gravity CP falls out of the stable range LC. FIG. 8 shows a state in which the training person 900 cannot adjust his/her balance and steps his/her left foot forward.

The actual displacement amount along the ΔC axis with respect to the load's center of gravity CP shown in the drawing is ΔC. Further, the displacement amount with respect to a line segment connected between the reference position RP and the load's center of gravity CP intersecting with a circumference curve of the stable range LC is defined as ΔCa. The displacement amount ΔCa is employed to determine the target speed. The value of ΔCa is $\Delta C_{min}$ or more and $\Delta C_{max}$ or less, and thus the movement control unit 203 can determine the target speed $V_T$ using the relationship of FIG. 7. When the target speed $V_T$ is determined in this way, the moving speed of the moving carriage 110 does not change suddenly. Moreover, since it can be expected that the training person 900 may immediately return his/her foot which has been stepped forward while changing his/her step, the training attempt may be continued. That is, it is possible to achieve both safety ensuring for the training person 900 and smooth carrying out of training attempts.

Note that the target speed $V_T$ of the moving carriage 110 may be set to be equal to or lower than an upper limit speed. The upper limit speed here may be a speed corresponding to the displacement amount ΔCa to be applied. When the load's center of gravity CP falls outside the stable range LC, it is also assumed that the training person 900 may be upset. Thus, for example, for a certain period after the load's center of gravity CP falls outside the stable range LC, a speed obtained by multiplying the speed corresponding to the displacement amount ΔCa to be applied by a coefficient of about 0.9 may be used as the target speed $V_T$.

Figure 9:
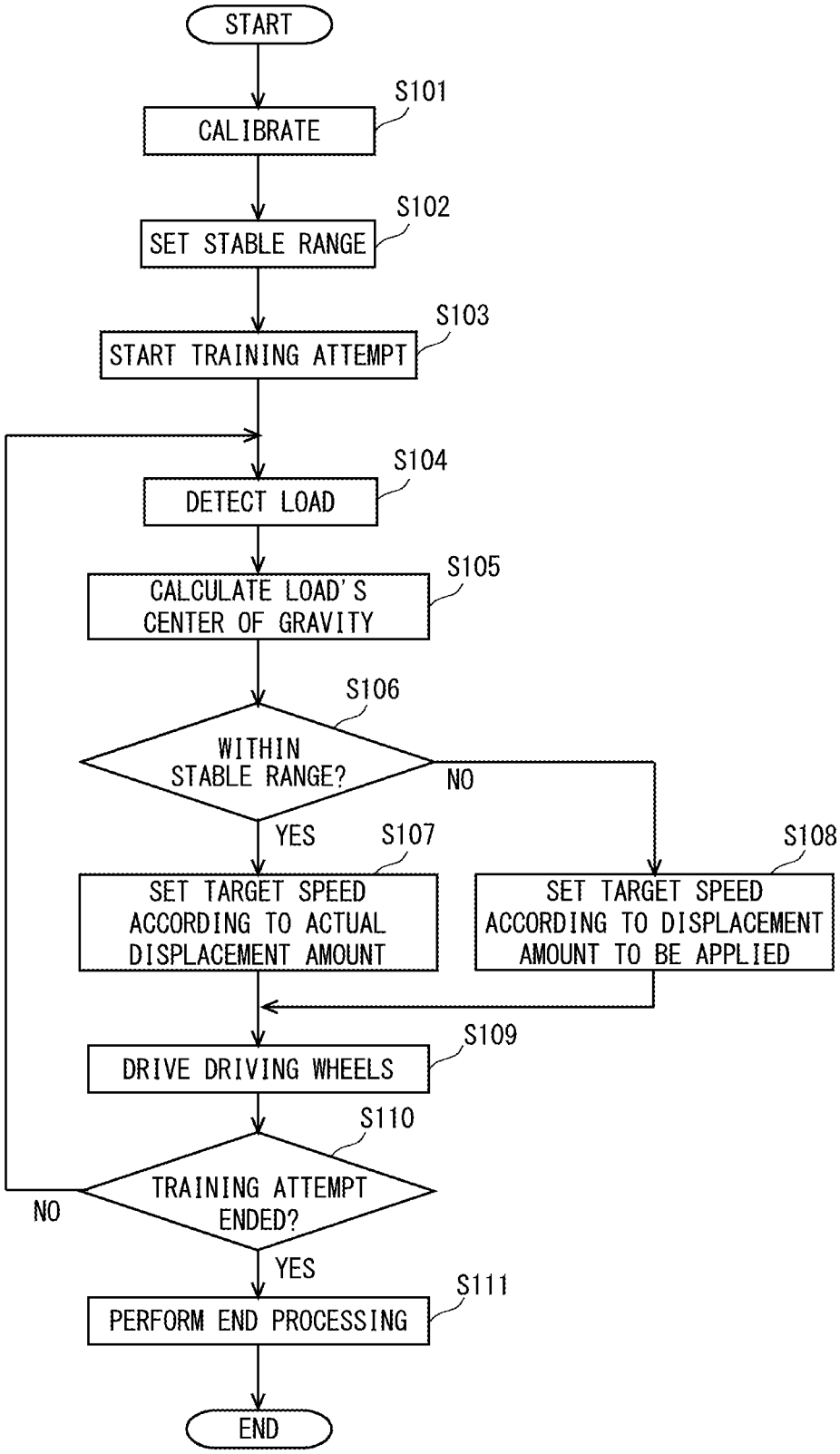
FIG. 9 shows a processing flow of a training attempt.

FIG. 9 is a flowchart showing a processing flow of a training attempt. For example, the flow is started in a state in which the training person 900 has boarded the boarding plate 130. The range setting unit 202 executes calibration in Step S101. Specifically, as described with reference to FIG. 3, the training person 900 is encouraged to perform a calibration work for sequentially shifting his/her center of gravity. For example, the display panel 170 displays "Next, shift your center of gravity to your right foot until right before your left foot is lifted". The load calculation unit 201 receives a detection signal from the load sensor 140 every time the center of gravity is shifted, and sequentially calculates the load's center of gravity $CP_F$, $CP_R$, $CP_B$, and $CP_L$. The range setting unit 202 proceeds to Step S102, and sets the stable range LC from the calculated load's center of gravity $CP_F$, $CP_R$, $CP_B$, and $CP_L$.

The arithmetic processing unit 200 proceeds to Step S103, reads the designated task game 241 from the memory 240, and starts a training attempt through the task game 241. The arithmetic processing unit 200 displays a video image in accordance with the progress of the task game 241 on the display panel 170 via the display control unit 230.

In Step S104, the load sensor 140 detects a load received from the training person 900's feet in accordance with the progress of the task game 241, and passes the detected detection signal to the load calculation unit 201. In Step S105, the load calculation unit 201 calculates the load's center of gravity from the received detection signal, and passes the calculated load's center of gravity to the movement control unit 203.

In Step S106, the movement control unit 203 determines whether the load's center of gravity received from the load calculation unit 201 is within the stable range LC set by the range setting unit 202. When the movement control unit 203 determines that the load's center of gravity is within the range, the process proceeds to Step S107, and sets the target speed of the moving carriage 110 according to the actual displacement amount ΔC corresponding to the calculated load's center of gravity. When the movement control unit 203 determines that the load's center of gravity is outside the range, the process proceeds to Step S108 where the movement control unit 203 calculates the displacement amount ΔCa to be applied from the calculated load's center of gravity, and sets the target speed of the moving carriage 110 according to the calculated displacement amount ΔCa as described using FIG. 8. When the target speed is set in Steps S107 or S108, the process proceeds to Step S109.

In Step S109, the movement control unit 203 calculates a driving torque corresponding to the set target speed, and transmits a driving signal for outputting the driving torque to the driving wheel unit 210. The movement control unit 203 sequentially acquires the rotational speed of the driving wheels 121 from the driving wheel unit 210 and performs feedback control so that the difference between the rotational speed and the target speed becomes zero.

In Step S110, the arithmetic processing unit 200 determines whether the training attempt has ended. The training attempt ends, for example, when the task game 241 ends, a set period of time elapses, or a target item is achieved. When the arithmetic processing unit 200 determines that the training attempt has not ended, the process returns to Step S104 where the training attempt is continued, whereas when the arithmetic processing unit 200 determines that the training attempt has ended, the process proceeds to Step S111. In Step S111, the arithmetic processing unit 200 executes end processing to end a series of processing. The end processing is to display the final score on the display panel 170 and update history information of the training that has been carried out so far.

In the training apparatus 100 described above, the target speed is limited when it is determined that the load's center of gravity of the training person 900 has fallen outside the stable range during the training attempt as the safety control performed by the movement control unit 203. However, the safety control is not limited to this. Several examples that can be applied in combination with each other will be described below.

Figure 10:
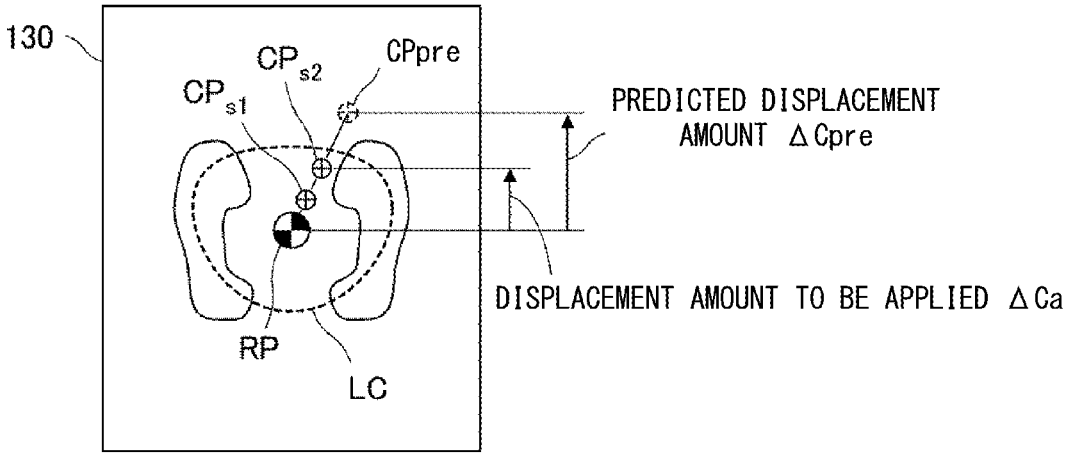
FIG. 10 shows a state in which the load's center of gravity is predicted to fall outside the stable range.

FIG. 10 shows a state in which the load's center of gravity is predicted to fall outside the stable range. The movement control unit 203 is able to perform the safety control at the time when it is predicted that the load's center of gravity of the training person 900 may fall out of the stable range before the load's center of gravity of the training person 900 actually falls out of the stable range. Specifically, when the load's center of gravity is a load's center of gravity $CP_{s1}$ at the sampling time T=t1 and is a load's center of gravity $CP_{s2}$ at the next sampling time T=t2, the movement control unit 203 determines whether a load's center of gravity CPpre after a predetermined time predicted from the positions of $CP_{s1}$ and $CP_{s2}$ is included in the stable range LC. When the movement control unit 203 determines that the load's center of gravity CPpre after the predetermined time is not included in the stable range LC, for example, as shown in the drawing, the movement control unit 203 performs the safety control to limit the target speed.

To be more specific, to determine the target speed, the movement control unit 203 docs not use the displacement amount ΔCpre corresponding to the load's center of gravity CPpre after the predicted predetermined time and instead uses a displacement amount at the point (T=t2) when the load's center of gravity is predicted to fall outside the stable range LC as a displacement amount ΔCa to be applied. Then, the movement control unit 203 determines the target speed $V_T$ using the relationship of FIG. 7 from the displacement amount ΔCa, and maintains the determined target speed until the calculated load's center of gravity and the predicted load's center of gravity are included in the stable range LC. When the calculated load's center of gravity and the predicted load's center of gravity are included in the stable range LC, the movement control unit 203 cancels maintaining of the target speed $V_T$ and determines the target speed according to the load's center of gravity at that time. When such safety control is performed, the speed change of the moving carriage 110 can be further prevented, so that the training person 900 can continue the training without getting upset.

In the example of the safety control described above, the displacement amount ΔCa to be applied when the calculated load's center of gravity or the predicted load's center of gravity exceeds the stable range LC is calculated, and the target speed $V_T$ corresponding to the calculated or predicted load's center of gravity is determined. That is, such control is performed that does not stop the moving carriage 110 in order to continue the training attempt. However, when emphasis is put on safety more than continuation of the training attempt, the moving carriage 110 may be controlled to stop.

Figure 11A:
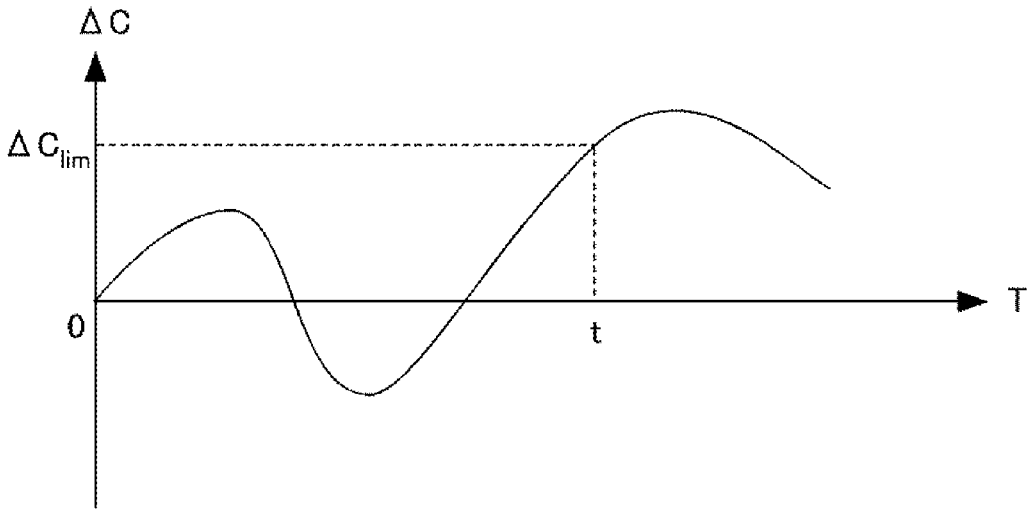
FIG. 11A shows an example of a displacement amount of a load's center of gravity.
Figure 11B:
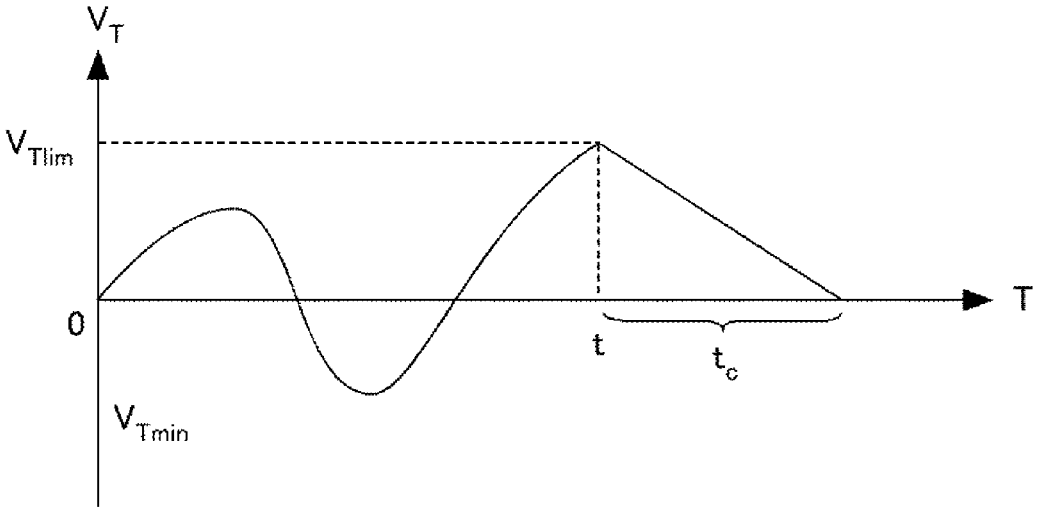
FIG. 11B shows an example of a change over time in a target speed of the moving carriage.

FIG. 11A shows an example of the displacement amount ΔC of the load's center of gravity, and FIG. 11B shows an example of a change over time in the target speed $V_T$ of the moving carriage 110 in such safety control. The horizontal axis of FIG. 11A represents the elapsed time T of the training attempt, and the vertical axis represents the displacement amount ΔC of the load's center of gravity. The horizontal axis of FIG. 11B represents the elapsed time T that is equivalent to that of FIG. 11A, and the vertical axis represents the target speed $V_T$.

When the displacement amount ΔC deviates from the stable range LC and reaches $\Delta C_{lim}$ at the time T=t, the movement control unit 203 gradually decreases the target speed to 0 over a certain period of time $t_c$ from the target speed $V_{Tlim}$ at that time. The certain period of time may be determined according to the magnitude of the target speed $V_{Tlim}$ and the progress of the rehabilitation training of the training person 900. When such safety control is performed, the training attempt can be safely interrupted, and the training person 900 can be calmed down. The movement control unit 203 may resume the training attempt when a resume instruction is received from the training person 900 or when a certain period of time has elapsed.

Figure 12:
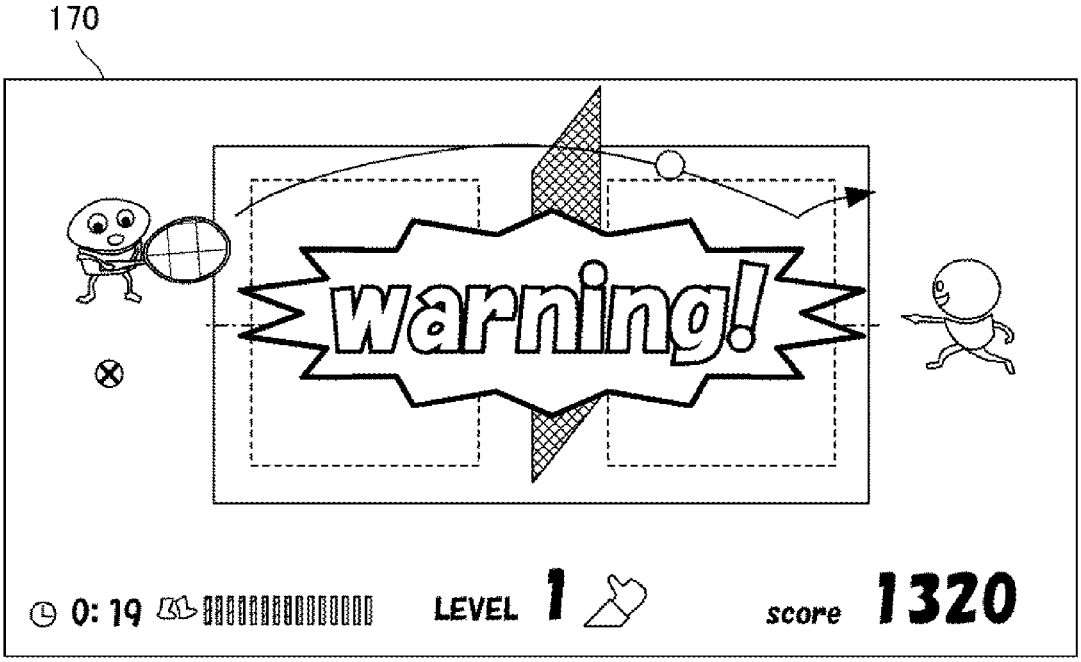
FIG. 12 shows an example of a warning displayed.

The safety control is not limited to the speed limit of the moving carriage 110. When emphasis is put on continuation of the training attempt, a warning may be displayed first. FIG. 12 shows an example of the warning displayed on the display panel 170.

When the calculated load's center of gravity or the predicted load's center of gravity exceeds the stable range LC during a training attempt, as shown in the drawing, the movement control unit 203 displays a warning image indicating a warning "Warning!" superimposed on the graphic video image of the task game via the display control unit 230. When such notification control is performed as the safety control, the training person 900 can recognize the possibility of sudden movement variations and take preventive measures such as grasping the handrail. Note that, for example, attention may be gotten by a voice in addition to the warning display.

In the above-described embodiments, the moving carriage 110 has a structure that moves back and forth, and thus the movement control and task games corresponding to such a structure are employed. However, when the moving carriage 110 has a structure that also moves in the right-left direction, the movement control and task games corresponding to such a structure that moves back and forth and also left and right may be employed. In the above-described embodiments, the speed control is performed by calculating the displacement amount ΔC in the front-rear direction, which is the moving direction of the moving carriage 110, with respect to the two-dimensionally defined stable range LC. However, when the moving carriage 110 can also move in the right-left direction, the moving direction and the target speed may be determined according to a vector from the reference position RP to the load's center of gravity.

The program can be stored and provided to a computer using any type of non-transitory computer readable media. Non-transitory computer readable media include any type of tangible storage media. Examples of non-transitory computer readable media include magnetic storage media (such as floppy disks, magnetic tapes, hard disk drives, etc.), optical magnetic storage media (e.g. magneto-optical disks), CD-ROM (compact disc read only memory), CD-R (compact disc recordable), CD-R/W (compact disc rewritable), and semiconductor memories (such as mask ROM, PROM (programmable ROM), EPROM (erasable PROM), flash ROM, RAM (random access memory), etc.). The program may be provided to a compute) using any type of transitory computer readable media. Examples of transitory computer readable media include electric signals, optical signals, and electromagnetic waves. Transitory computer readable media can provide the program to a computer via a wired communication line (e.g. electric wires, and optical fibers) or a wireless communication line.

From the disclosure thus described, it will be obvious that the embodiments of the disclosure may be varied in many ways. Such variations are not to be regarded as a departure from the spirit and scope of the disclosure, and all such modifications as would be obvious to one skilled in the art are intended for inclusion within the scope of the following claims.

What is claimed is:

1. A balance training system comprising:

a moving carriage configured to be able to move on a moving surface by driving a driving unit;

a detection unit configured to detect a load received from training person's feet standing on the moving carriage;

a calculation unit configured to calculate a load's center of gravity of the training person's feet on a boarding surface from the load detected by the detection unit;

a setting unit configured to set a stable range, the stable range being a range of the load's center of gravity of the training person collected in a calibration work while the training person maintains upright on the boarding surface; and a control unit configured to perform safety control for ensuring safety during a training attempt for driving the driving unit to move the moving carriage when the control unit determines that the load's center of gravity has fallen outside the stable range based on a result of the calculation by the calculation unit or when the control unit predicts that the load's center of gravity is going to fall outside the stable range based on the result of the calculation by the calculation unit.

2. The balance training system according to claim 1, wherein the setting unit is configured to set the stable range based on the load's center of gravity calculated by the calculation unit in the calibration work performed by the training person prior to the training attempt.

3. The balance training system according to claim 1, wherein the control unit is configured to perform deceleration control for gradually decreasing a moving speed of the moving carriage as the safety control.

4. The balance training system according to claim 1, wherein the control unit is configured to perform limit speed control for limiting a moving speed of the moving carriage to less than or equal to a preset limit speed as the safety control.

5. The balance training system according to claim 1, wherein the control unit is configured to perform notification control for getting attention as the safety control.

6. The balance training system according to claim 1, wherein a boundary of the stable range is determined based on the center of gravity when a portion of the training person's feet is detached from the moving carriage during the calibration work.

7. The balance training system according to claim 1, wherein:

the detection unit includes a plurality of load sensors; and the calculation unit is configured to calculate the load's center of gravity of the training person's feet on the boarding surface based on detection signals from the plurality of load sensors.

8. A balance training system comprising:

a moving carriage configured to be able to move on a moving surface by driving a driving unit;

a sensor configured to detect a load received from training person's feet standing on the moving carriage; and a processor configured to calculate a load's center of gravity of the training person's feet on a boarding surface from the load detected by the sensor, to set a stable range, the stable range being a range of the load's center of gravity of the training person collected in a calibration work while the training person maintains upright on the boarding surface, and to perform safety control for ensuring safety during a training attempt for driving the driving unit to move the moving carriage when it is determined that the load's center of gravity has fallen outside the stable range based on a result of the calculation or when it is predicted that the load's center of gravity is going to fall outside the stable range based on the result of the calculation.

9. The balance training system according to claim 8, wherein a boundary of the stable range is determined based on the center of gravity when a portion of the training person's feet is detached from the moving carriage during the calibration work.

10. The balance training system according to claim 8, wherein:

the sensor includes a plurality of load sensors; and the processor is configured to calculate the load's center of gravity of the training person's feet on the boarding surface based on detection signals from the plurality of load sensors.

11. A control method for a balance training system for enabling a training person to perform balance training while standing on a moving carriage moving on a moving surface, the control method comprising:

setting a stable range, the stable range being a range of a load's center of gravity of the training person collected in a calibration work while the training person maintains upright on a boarding surface of the moving carriage;

detecting a load received from training person's feet standing on the moving carriage;

calculating the load's center of gravity of the training person's feet on the boarding surface from the load detected in the detecting; and performing safety control for ensuring safety when it is determined that the load's center of gravity has fallen outside the stable range based on a result of the calculation in the calculating or when it is predicted that the load's center of gravity is going to fall outside the stable range based on the result of the calculation in the calculating.

12. The control method according to claim 11, wherein a boundary of the stable range is determined based on the center of gravity when a portion of the training person's feet is detached from the moving carriage during the calibration work.

13. A non-transitory computer readable medium storing a control program for a balance training system for enabling a training person to perform balance training while standing on a moving carriage moving on a moving surface, the control program causing a computer to execute:

setting a stable range, the stable range being a range of a load's center of gravity of the training person collected in a calibration work while the training person maintains upright on a boarding surface of the moving carriage;

detecting a load received from training person's feet standing on the moving carriage;

calculating the load's center of gravity of the training person's feet on the boarding surface from the load detected in the detecting; and performing safety control for ensuring safety when it is determined that the load's center of gravity has fallen outside the stable range based on a result of the calculation in the calculating or when it is predicted that the load's center of gravity is going to fall outside the stable range based on the result of the calculation in the calculating.

14. The non-transitory computer readable medium according to claim 13, wherein a boundary of the stable range is determined based on the center of gravity when a portion of the training person's feet is detached from the moving carriage during the calibration work.

* * * * *